US005740904A

United States Patent [19]

Ishizuka et al.

[11] Patent Number: 5,740,904

[45] Date of Patent: Apr. 21, 1998

[54] SWITCH ASSEMBLY WITH INTERNAL ELECTRONIC COMPONENTS

[75] Inventors: Kenichi Ishizuka; Osamu Furukawa, both of Tokyo, Japan

[73] Assignee: Niles Parts Co., Ltd., Tokyo, Japan

[21] Appl. No.: 711,945

[22] Filed: Sep. 4, 1996

[30] Foreign Application Priority Data

Dec. 28, 1995 [JP] Japan ..... 7-353045

[51] Int. Cl.[6] ..... H01H 1/64

[52] U.S. Cl. ..... 200/293; 200/302.1

[58] Field of Search ..... 200/237, 238, 200/293, 302.1, 302.3, 304, 502, 505, 520, 530, 537

[56] References Cited

U.S. PATENT DOCUMENTS

| | | | |
|---|---|---|---|
| 4,584,546 | 4/1986 | Hattori et al. | 335/186 |
| 4,780,580 | 10/1988 | Sawada | 200/68.2 |
| 5,412,166 | 5/1995 | Krupp et al. | 200/6 R |
| 5,598,918 | 2/1997 | Malecke et al. | 200/558 |

*Primary Examiner*—Matthew V. Nguyen
*Attorney, Agent, or Firm*—Ronald P. Kananen

[57] ABSTRACT

A switch assembly with internal electronic components that enables easy assembly and is dustproof, and that can be oriented relative to the main board of a power window control switch or other devices with a lesser degree of limitation and has a wide variety of applications. A plurality of electronic components are mounted to one side of a plate 1. A plurality of switch electrodes 3 are formed in the other side of the plate 1. A switch case 6 is resiliently fit over the base plate 1. The switch case 6 includes an elongated aperture 61 within which a lever 41 of a switch operating mechanism 4 is loosely fit, pawls 62 adapted for resilient engagement with the base plate 1, projections 63 and a base 64. The switch operating mechanism 4 holds a movable contact 5. The switch case 6 defines a space 65 adjacent to the switch operating mechanism 4 and the movable contact 5. The switch electrodes 3 are sealably contained within the space 65 when the switch case 6 is resiliently fit over the base plate 1. The lever 41 includes a plurality of combined projections and recesses 41*a* to 41*f* arranged in a direction transverse to the direction in which the switch operating mechanism 4 is moved.

17 Claims, 2 Drawing Sheets

SWITCH ASSEMBLY WITH INTERNAL ELECTRONIC COMPONENTS

BACKGROUND OF THE INVENTION

1. Field of the Invention

The present invention relates to an improved switch assembly within which various electronic components are contained and, more particularly, to an improvement in such a switch assembly which is mounted to arm rests or other vehicle parts surrounded by dust, and which is suitable for use, for example, as a power window control switch.

2. Description of the Prior Art

A conventional switch assembly of this type is disclosed, for example, in Japanese Laid-Open Utility Model Publication No. Hei 5-92926. The prior art switch assembly includes a base plate, a circuit formed in a predetermined pattern in one side of the base plate, and a jumper wire or switch electrode and electronic components mounted to the other side of the base plate.

However, the switch electrode is exposed to ambient atmosphere and is subject to contact failure due to dust or foreign matter. Thus, the prior art switch assembly cannot be used in a place that is subjected to dust.

The switch assembly of this invention is typically mounted to the main board of a power window control switch or other devices. In such a case, there is a limit on the orientation of the switch assembly relative to the main board.

SUMMARY OF THE INVENTION

It is an object of the present invention to provide a switch assembly that solves the problems associated with the conventional switch assembly described above.

More specifically, it is an object of the present invention to provide a switch assembly with internal electronic components, that enables easy assembly and is dustproof, and that can be oriented freely relative to the main board of a power window control switch.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a switch assembly with internal electronic components is provided comprising a base plate, electronic components mounted to one side of the base plate, switch electrodes formed in the other side of the base plate, and a switch case including a switch operating mechanism and a movable contact. The switch case is resiliently fit over the base plate to seal the switch electrodes. The switch operating mechanism includes a lever extending out of the switch case and a plurality of combined projections and recesses arranged in a direction transverse to the direction in which the switch operating mechanism is moved.

The base plate of the present invention is preferably a hybrid integrated circuit board. In a preferred embodiment, the electronic components mounted to the base plate collectively form a vehicle power window control circuit. The base plate preferably includes a plurality of lead terminals adapted to provide an electrical connection between the electronic components mounted to the base plate and the main board of a power window control switch.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
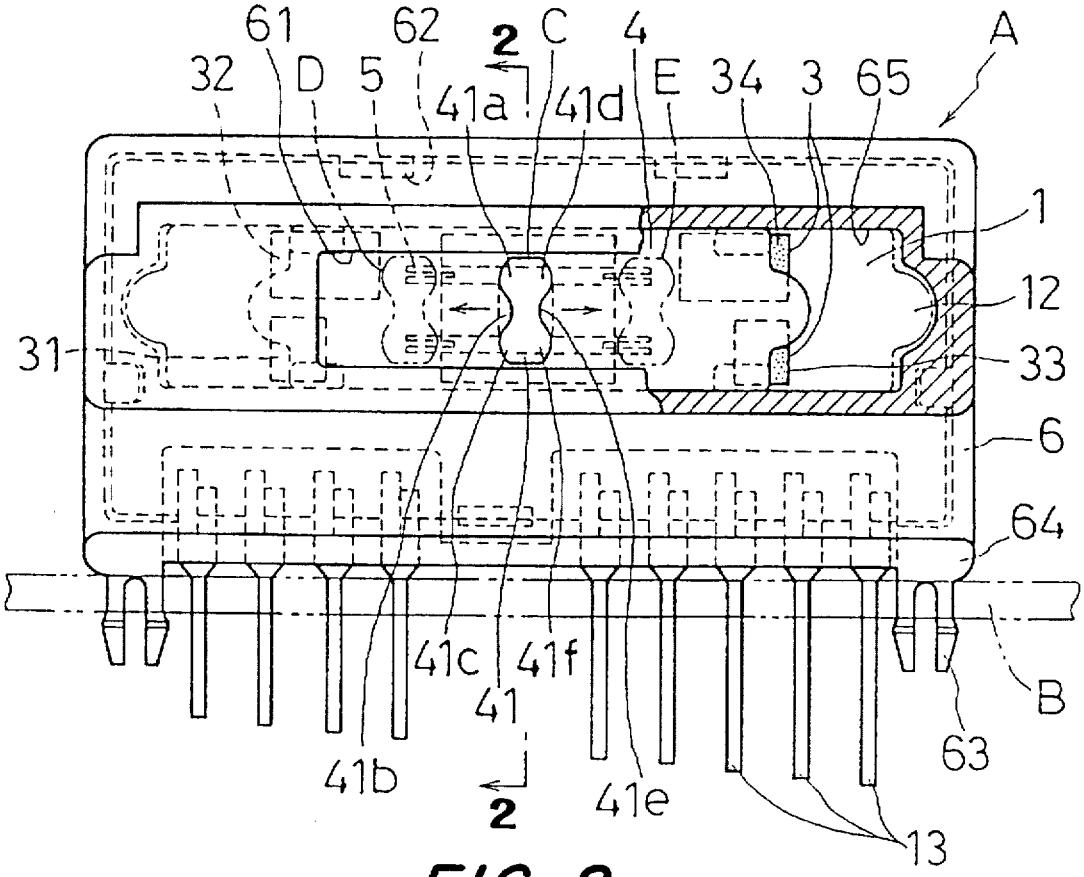
FIG. 1 is a front view, partly broken away, of a switch assembly according to a preferred embodiment of the present invention.
Figure 2:
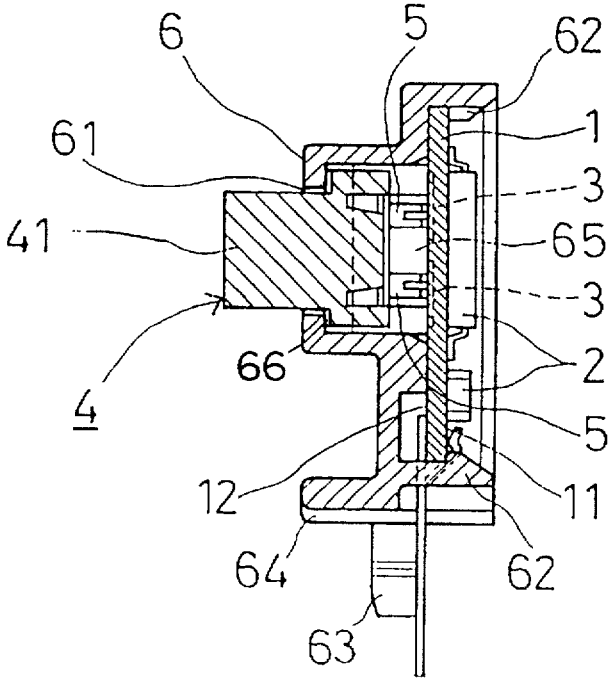
FIG. 2 is a sectional view taken along line 2—2 of FIG. 1.

The present invention will now be described, by way of example, with reference to FIGS. 1 to 3 of the accompanying drawings.

In the drawings, a switch assembly is illustrated comprising a base plate 1, electronic components 2, switch electrodes 3, a switch operating mechanism 4, a movable contact 5, and a switch case 6. Reference will next be made to each of these components.

First, the base plate 1 is made of epoxy resin with glass fiber, ceramic or other materials. An electrically conductive line is formed in a predetermined pattern in one side 11 of the base plate 1. The electronic components 2 are mounted to the electrically conductive line. The switch electrodes 3 are formed in the other side 12 of the base plate 1. A plurality of lead terminals 13 are soldered to the lower end of the base plate 1. The lead terminals 13 provide an electrical connection between the electronic components 2 and a main board B of a power window control switch. The lead terminals 13 are made by a lead frame that is typically used in a hybrid integrated circuit board.

Next, the switch case 6 includes an elongated aperture 61, pawls 62 adapted to resiliently engage the base plate 1, projections 63 adapted to secure a switch assembly A to the main board B of the power window control switch, and a base 64. The switch operating mechanism 4 holds the movable contact 5 and includes a lever 41 loosely fit within the elongated aperture 61. The switch case 6 defines a space 65 adjacent to the switch operating mechanism 4 and the movable contact 5. The switch electrodes 3 are sealably contained within this space 65 when the switch case 6 is resiliently fit over the base plate 1. That is, the switch electrodes 3 are dustproof. To improve the seal integrity, a sheet 66, made from resinous film or unwoven fabric, may be disposed between the switch case 6 and the switch operating mechanism 4.

The lever 41 extends generally perpendicularly out of the switch case 6 and includes a plurality of combined projections and recesses 41*a* to 41*f* arranged in a direction transverse to the direction in which the switch operating mechanism 4 is moved. Thus, the lever 41 has a generally gourd-shaped section, as shown in FIG. 1. The gourd-shaped section has recesses 41*b* and 41*e* on opposite sides of the lever 41 that extend in a direction away from the switch case 6.

The power window control switch includes a control knob 7, which is pivotally mounted about an axis 71. As shown in FIG. 3, the axis 71 extends in a direction generally perpendicular to a plane containing said base plate 1. The control knob 7 has a drive mechanism 72 that includes a groove 73 for receiving the movable lever 41. The drive mechanism 72 has engagement portions defined on opposite sides of the groove for engaging respective opposite sides of the movable lever 41. Specifically, the engagement portions are engaged with the combined projections and recesses 41*a* to 41*f* to transmit force from the control knob 7 to the lever 41.

Figure 3:
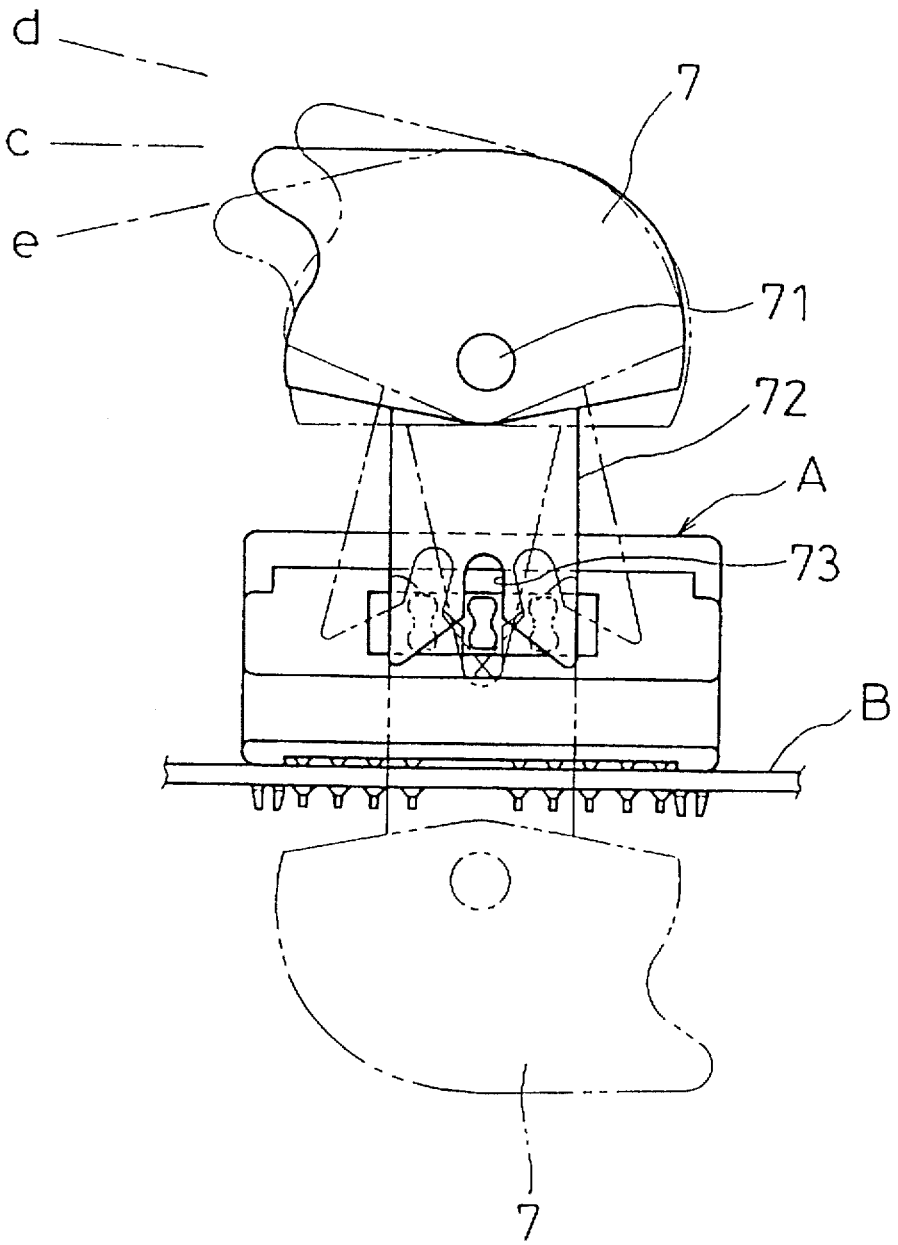
FIG. 3 illustrates a control knob attached to the switch assembly shown in FIG. 1.

The shape of the lever 41 facilitates engagement of the groove 73 of the drive mechanism 72 with the combined projections and recesses 41*a* to 41*f* regardless of whether the switch assembly A is mounted to the control knob 7 or the main board, as shown in FIG. 3. In other words, the switch assembly A is mounted to the main board B with a lesser degree of limitation on its orientation.

Reference will now be made to the operation of the switch assembly according to the present invention.

If a vehicle occupant moves the control knob 7 of the power window control switch from a neutral position c, as shown in FIG. 3, to a closed position d so as to close a glass window, a force is transmitted from the control knob 7 to the lever 41. This force then causes the lever 41 to move from a neutral position, as shown by solid line C in FIG. 1, to an automatic UP operating position, as shown by broken line D, or a manual UP operating position between the neutral position and the automatic UP operating position. At this time, the switch operating mechanism 4 and the movable contact 5 are moved with the lever 41. The movable contact 5 is then electrically connected to an automatic electrode 31 or a manual electrode 32 of the switch electrodes 3.

When the movable contact 5 is connected to the automatic electrode 31 or the manual electrode 32, an electric pulse signal is sent to the electronic components 2. In the event that the movable contact 5 is connected, for example, to the automatic electrode 31, a pulse signal to that effect is sent to the electronic components 2 whereby the glass window is continuously moved to its fully closed position even if the vehicle occupant stops operating the control knob 7. In the event that the movable contact 5 is connected only to the manual electrode 32, the electronic components 2 receive a pulse signal to that effect and are operable to close the glass window only when the occupant operates the control knob 7.

When the vehicle occupant moves the control knob 7 of the power window control switch from the neutral position c, as shown in FIG. 3, to an open position e so as to open the glass window, a force is transmitted from the control knob 7 to the lever 41. This force causes the lever 41 to move from the neutral position, as shown by solid line C in FIG. 1, to an automatic DOWN operating position, as shown by broken line E, or a manual DOWN operating position between the neutral position and the automatic DOWN operating position. At this time, the switch operating mechanism 4 and the movable contact 5 are moved with the lever 41. The movable contact 5 is then electrically connected to an automatic electrode 33 or a manual electrode 34 of the switch electrodes 3.

When the movable contact 5 is connected to the automatic electrode 33 or the manual electrode 34, an electric pulse signal is sent to the electronic components 2. In the event that the movable contact 5 is connected, for example, to the automatic electrode 33, a pulse signal to that effect is sent to the electronic components 2 whereby the glass window is continuously moved to its fully open position even if the occupant stops operating the control knob 7. In the event that the movable contact 5 is connected to the manual electrode 34, the electronic components 2 receive a pulse signal to that effect and are operable to open the glass window only when the occupant operates the control knob 7.

The advantages of the present invention are as follows:

(1) The invention provides a switch assembly with internal electronic components comprising a base plate, electronic components mounted to one side of the base plate, switch electrodes formed in the other side of the base plate, and a switch case including a switch operating mechanism and a movable contact, the switch case being resiliently fit over the base plate to seal the switch electrodes, wherein the switch operating mechanism includes a lever extending out of the switch case and a plurality of combined projections and recesses arranged in a direction transverse to the direction in which the switch operating mechanism is moved. This arrangement prevents the switch assembly from being subject to contact failure due to dust or other foreign matter, allows the switch assembly to be mounted to a region that is subjected to dust, enables easy assembly, effectively protects the switch assembly from dust, and allows the switch assembly to be oriented relative to the main board of a power window control switch or other devices with a lesser degree of limitation.

(2) According to the present invention, the base plate is a hybrid integrated circuit board. The switch case includes a switch operating mechanism and a movable contact and is resiliently fit over the existing hybrid integrated circuit to constitute a switch assembly within which various electronic components are contained.

(3) Also, according to the present invention, the switch assembly contains electronic components for use with a vehicle power window control circuit. Thus, the power window control switch is dustproof, compact and has fewer parts.

(4) According to the present invention, the lead terminals are used to provide an electrical connection between the electronic components and the main board of the power window control switch. The lead terminals can be made of a lead frame typically for use with a hybrid integrated circuit board.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

We claim:

1. A switch assembly of a power window switch, the switch assembly having internal electronic components, comprising:

a base plate (1);

electronic components (2) mounted to one side (11) of the base plate (1);

switch electrodes (3) formed in the other side (12) of the base plate (1); and a switch case (6) including a switch operating mechanism (4) and a movable contact (5), means for resiliently fitting the base plate to said switch case to seal the switch electrodes (3), said means for resiliently fitting comprising a plurality of pawls on said switch case;

said switch operating mechanism (4) including a lever (41), said lever (41) extending out of the switch case (6) and including a plurality of combined projections and recesses (41*a* to 41*f*) arranged in a direction transverse to the direction in which the switch operating mechanism (4) is moved.

2. The switch assembly with internal electronic components as set forth in claim 1, wherein said base plate (1) is a hybrid integrated circuit board.

3. The switch assembly with internal electronic components as set forth in claim 1, wherein said electronic components (2) mounted to the base plate (1) collectively form a vehicle power window control circuit.

4. The switch assembly with internal electronic components as set forth in claim 1, wherein said base plate (1) includes a plurality of lead terminals (13) adapted to provide an electrical connection between the electronic components (2) mounted to the base plate (1) and a main board (B) of a power window control switch.

5. A switch assembly of a power window switch, the switch assembly having internal electronic components, comprising;

a base plate (1);

electronic components (2) mounted to one side 11) of the base plate (1);

switch electrodes (3) formed in the other side (12) of the base plate (1);

a switch case (6) disposed over the switch electrodes (3);

means for resiliently fitting the base plate to said switch case, said means for resiliently fitting comprising a plurality of pawls on said switch case;

a switch operating mechanism (4) having a movable contact (5) mounted thereto for selective engagement with said switch electrodes (3), said switch operating mechanism (4) including a movable lever (41) for engagement by a drive mechanism (72), said lever (41) extending out of said switch case (6) and having recesses (41*b*, 41*e*) formed on opposite sides of the lever (41), said recesses respectively facing directions in which the switch operating mechanism (4) is moved, said recesses (41*b*, 41*e*) extending along said lever (41) in a direction away from the switch case (6) to facilitate engagement of the lever (41) by the drive mechanism (72).

6. The switch assembly with internal electronic components as set forth in claim 5, wherein said electronic components (2) mounted to the base plate (1) collectively form a vehicle power window control circuit.

7. The switch assembly with internal electronic components as set forth in claim 5, wherein said base plate (1) includes a plurality of lead terminals (13) adapted to provide an electrical connection between the electronic components (2) mounted to the base plate (1) and a main board (B) of a power window control switch.

8. A vehicle power window control assembly, comprising:

a main board (B) of a power window control switch;

a switch assembly comprising a base plate (1) having electronic components (2) mounted to one side (11) of the base plate (1), switch electrodes (3) formed in the other side (12) of the base plate (1), a switch case (6) disposed over the switch electrodes (3), and means for resiliently fitting the base plate to said switch case, said means for resiliently fitting comprising a plurality of pawls on said switch case;

said base plate (1) extending generally perpendicularly to said main board and having a first edge in close proximity to said main board, said base plate (1) including a plurality of lead terminals (13) extending from said first edge of said base plate (1) through said main board for providing an electrical connection between the electronic components (2) mounted to the base plate (1) and said main board (B); and a switch operating mechanism (4) having a movable contact (5) mounted thereto is provided for selective engagement with said switch electrodes (3), said switch operating mechanism (4) including a movable lever (41) for engagement by a drive mechanism (72), said lever (41) extending out of said switch case (6) and having recesses (41*b*, 41*e*) on opposite sides of the lever (41), said recesses respectively facing directions in which the switch operating mechanism (4) is moved, said recesses (41*b*, 41*e*) extending along said lever (41) in a direction away from the switch case (6) to facilitate engagement of the lever (41) by the drive mechanism (72).

9. The vehicle power window control assembly as set forth in claim 8, further comprising a control knob (7) pivotally mounted about an axis (71), said axis (71) extending in a direction generally perpendicular to a plane containing said base plate (1), said drive mechanism (72) being connected to said control knob (7) for pivoting movement therewith, whereby pivotal movement of said control knob (7) causes movement of said movable lever 41.

10. The vehicle power window control assembly as set forth in claim 9, wherein said drive mechanism (72) comprises a groove (73) for receiving said movable lever (41), and said drive mechanism (72) has engagement portions defined on opposite sides of said groove (73) for engaging respective opposite sides of said movable lever (41).

11. The vehicle power window control assembly as set forth in claim 8, wherein said switch electrodes (3) and said movable contact (5) are contained within a sealed space (65) defined by said switch case (6), said switch operating mechanism (4), and said base plate (1).

12. The switch assembly with internal electronic components as set forth in claim 1, wherein said pawls comprise the sole means for preventing separation of said base plate from said switch case.

13. The switch assembly with internal electronic components as set forth in claim 1, wherein a resinous film is disposed between the switch case and the switch operating mechanism to enhance sealing.

14. The switch assembly with internal electronic components as set forth in claim 5, wherein said pawls comprise the sole means for preventing separation of said base plate from said switch case.

15. The switch assembly with internal electronic components as set forth in claim 5, wherein a resinous film is disposed between the switch case and the switch operating mechanism to enhance sealing.

16. The vehicle power window control assembly as set forth in claim 8, wherein said pawls comprise the sole means for preventing separation of said base plate from said switch case.

17. The vehicle power window control assembly as set forth in claim 8, wherein a resinous film is disposed between the switch case and the switch operating mechanism to enhance sealing.

* * * * *